US008969699B2

(12) United States Patent
Tabata et al.

(10) Patent No.: US 8,969,699 B2
(45) Date of Patent: Mar. 3, 2015

(54) MUSICAL INSTRUMENT, METHOD OF CONTROLLING MUSICAL INSTRUMENT, AND PROGRAM RECORDING MEDIUM

(71) Applicant: Casio Computer Co., Ltd., Shibuya-ku, Tokyo (JP)

(72) Inventors: Yuji Tabata, Tokyo (JP); Ryutaro Hayashi, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 173 days.

(21) Appl. No.: 13/794,317

(22) Filed: Mar. 11, 2013

(65) Prior Publication Data

US 2013/0239783 A1 Sep. 19, 2013

(30) Foreign Application Priority Data

Mar. 14, 2012 (JP) ..... 2012-057512

(51) Int. Cl.
*A63H 5/00* (2006.01)
*G10H 1/00* (2006.01)

(52) U.S. Cl.
CPC ..... *G10H 1/0008* (2013.01); *G10H 2220/455* (2013.01); *G10H 2230/015* (2013.01); *G10H 2230/281* (2013.01); *G10H 2240/211* (2013.01)
USPC ..... 84/609

(58) Field of Classification Search
CPC ..... G10H 1/0008; G10H 2220/455; G10H 2240/211; G10H 2230/281; G10H 2230/015
USPC ..... 84/609
See application file for complete search history.

(56) References Cited

U.S. PATENT DOCUMENTS

| | | | | |
|---|---|---|---|---|
| 5,442,168 | A * | 8/1995 | Gurner et al. | 463/36 |
| RE37,654 | E * | 4/2002 | Longo | 84/626 |
| 6,388,183 | B1 * | 5/2002 | Leh | 84/645 |
| 6,918,829 | B2 * | 7/2005 | Ikariko | 463/5 |
| 7,723,604 | B2 * | 5/2010 | Bang et al. | 84/615 |
| 2001/0035087 | A1 * | 11/2001 | Subotnick | 84/600 |

FOREIGN PATENT DOCUMENTS

JP 3599115 B2 12/2004

* cited by examiner

*Primary Examiner* — Jianchun Qin
(74) *Attorney, Agent, or Firm* — Holtz, Holtz, Goodman & Chick PC

(57) ABSTRACT

A CPU (31) of a musical instrument (1) calculates distances between central positions of a plurality of virtual pads (81) and a position of a marker unit (15), by making adjustment such that a distance is shorter as a size associated with the virtual pad (81) is larger. The CPU 31 identifies a virtual pad (81) corresponding to the shortest distance among the distances calculated, as a virtual pad (81) for outputting sound. The CPU (31) identifies a tone corresponding to the virtual pad (81) for outputting sound by referring to set layout information.

15 Claims, 8 Drawing Sheets

MUSICAL INSTRUMENT, METHOD OF CONTROLLING MUSICAL INSTRUMENT, AND PROGRAM RECORDING MEDIUM

This application is based upon and claims the benefit of priority from the prior Japanese Patent Application No. 2012-057512, filed Mar. 14, 2012, and the entire contents of which are incorporated herein by reference.

BACKGROUND OF THE INVENTION

1. Field of the Invention

The present invention relates to a musical instrument, a method of controlling a musical instrument, and a program recording medium.

2. Related Art

Conventionally, a musical instrument has been proposed in which, upon detecting a performer's action for a musical performance, electronic sound is generated in accordance with the action for the musical performance. For example, a musical instrument (air drum) has been known that generates sound of percussion instruments with only a stick-like musical performance member with a built-in sensor. This musical instrument detects an action for a musical performance by using a sensor that is built in the musical performance member, and generates sound of percussion instruments in accordance with a performer's action for a musical performance as if hitting a drum, such as holding and waving the musical performance member in his/her hand.

According to such a musical instrument, musical sound of the musical instrument can be generated without requiring a real musical instrument; therefore, the performer can enjoy a musical performance without being subjected to limitations in the place or space for the musical performance.

For example, Japanese Patent Publication No. 3599115 proposes a musical instrument game device that captures an image of a performer's action for a musical performance using a stick-like musical performance member, and which displays a synthetic image on a monitor by synthesizing the captured image of the action for the musical performance and a virtual image indicating a set of musical instruments.

In a case in which the position of the musical performance member in the captured image enters any musical instrument area in a virtual image having a plurality of musical instrument areas, this musical instrument game device generates sound corresponding to the musical instrument area in which the position is located.

However, in a case in which each part of the set of musical instruments is associated with a musical instrument area, and sound is generated based on the musical instrument area, such as a case of the musical instrument game device disclosed in Japanese Patent Publication No. 3599115, when a performer adjusts a position of each part of the set of musical instruments to a favorable position for the performer, the musical instrument area corresponding to each part is required to be finely adjusted, and such adjustment work is complicated.

In a case in which the musical instrument game device disclosed in Japanese Patent Publication No. 3599115 is applied as it is, the performer cannot actually visually recognize the set of virtual musical instruments, and thus cannot intuitively grasp the arrangement of each part of the set of musical instruments. Therefore, in a case in which the performer operates the musical performance member, the position of the musical performance member may deviate from the position of the virtual musical instrument with which the performer attempts to generate sound, and the sound may not be generated as intended by the performer.

SUMMARY OF THE INVENTION

The present invention has been made in view of such a situation, and an object of the present invention is to provide a musical instrument, a method of controlling a musical instrument, and a program recording medium, in which sound can be generated by detecting an action for a musical performance as intended by a performer.

A musical instrument according to one aspect of the present invention is characterized by including: a musical performance member that is operated by a performer; an operation detection unit that detects a predetermined operation performed by way of the musical performance member; an image capturing unit that captures an image in which the musical performance member is a subject; a position detection unit that detects a position of the musical performance member on a plane of the image captured; a storage unit that stores layout information including a central position and a size of a virtual musical instrument, for each of a plurality of virtual musical instruments provided on the plane of the image captured; a distance calculation unit that calculates distances between a position detected by the position detection unit and respective central positions of the virtual musical instruments, based on corresponding sizes of the corresponding virtual musical instruments, in a case in which the operation detection unit detects the predetermined operation; a musical instrument identification unit that identifies a virtual musical instrument corresponding to the shortest distance among the distances calculated by the distance calculation unit; and a sound generation instruction unit that instructs generation of musical sound corresponding to the virtual musical instrument identified by the musical instrument identification unit.

According to the present invention, it is possible to generate sound by detecting an action for a musical performance as intended by a performer.

DETAILED DESCRIPTION OF THE INVENTION

Descriptions are hereinafter provided for an embodiment of the present invention with reference to the drawings.

General Description of Musical Instrument 1

Figure 1A:
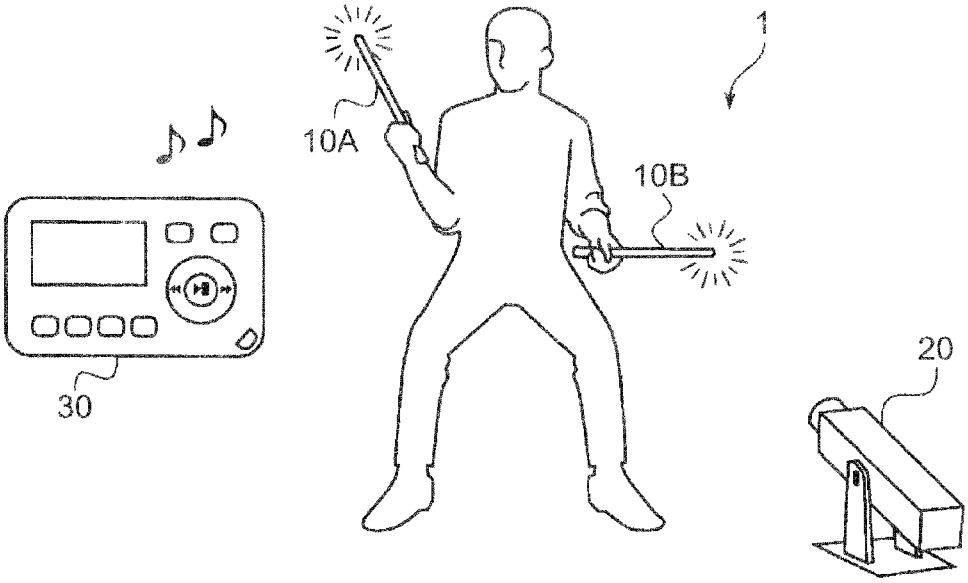
FIG. 1A and FIG. 1B are a diagram showing an overview of an embodiment of a musical instrument of the present invention.
Figure 1B:
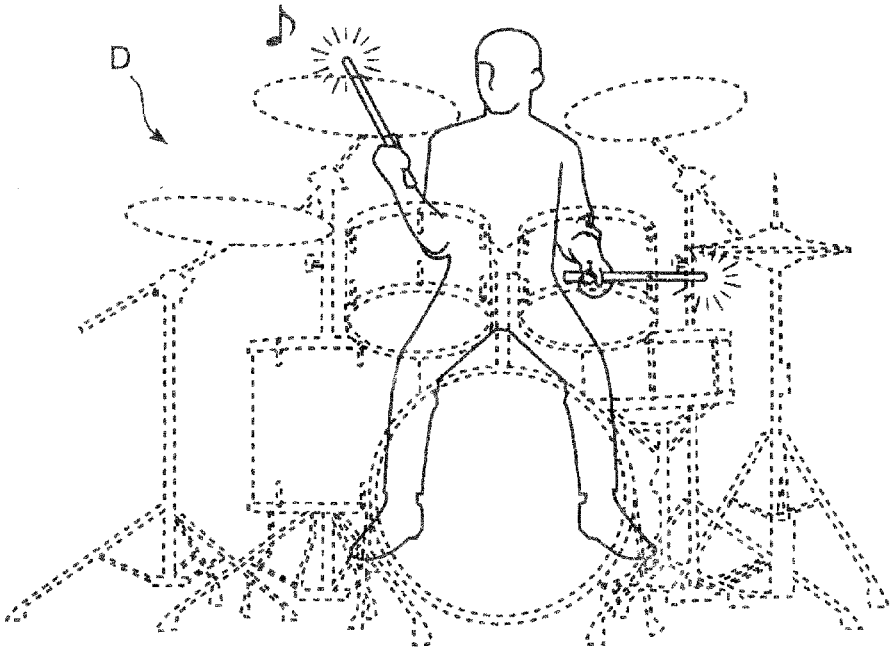

First, with reference to FIG. 1A and FIG. 1B, general descriptions are provided for a musical instrument 1 as an embodiment of the present invention.

As shown in FIG. 1A, the musical instrument 1 of the present embodiment is configured to include stick units 10A and 10B, a camera unit 20, and a center unit 30. The musical instrument 1 of the present embodiment includes the two stick units 10A and 10B for the purpose of achieving a virtual drum musical performance by using two sticks; however, the number of stick units is not limited thereto. For example, the number of stick units may be one, or may be three or more. In the following descriptions where it is not necessary to distinguish between the stick units 10A and 10B, the stick units 10A and 10B are collectively referred to as the "stick unit 10".

The stick unit 10 is a longitudinally extending stick-like member for a musical performance. A performer holds one end (base side) of the stick unit 10 in his/her hand, and the performer swings the stick unit 10 up and down using his/her wrist, etc. as an action for a musical performance. In order to detect such an action for a musical performance of the performer, various sensors such as an acceleration sensor and an angular velocity sensor (a motion sensor unit 14 to be described later) are provided to the other end (tip side) of the stick unit 10. Based on the action for the musical performance detected by the various sensors, the stick unit 10 transmits a note-on event to the center unit 30.

A marker unit 15 (see FIG. 2) (to be described below) is provided on the tip side of the stick unit 10, such that the tip of the stick unit 10 can be distinguished by the camera unit 20 when an image thereof is captured.

The camera unit 20 is configured as an optical image capturing device that captures a space (hereinafter referred to as "image capturing space") at a predetermined frame rate. The performer holding the stick unit 10 and making an action for a musical performance is included as a subject in the image capturing space. The camera unit 20 outputs images thus captured as data of a moving image. The camera unit 20 identifies position coordinates of the marker unit 15 that is emitting light in the image capturing space. The camera unit 20 transmits data indicating the position coordinates (hereinafter referred to as "position coordinate data") to the center unit 30.

When the center unit 30 receives a note-on event from the stick unit 10, the center unit 30 generates predetermined musical sound, based on the position coordinate data of the marker unit 15 at the time of receiving the note-on event. More specifically, the center unit 30 stores position coordinate data of a virtual drum set D shown in FIG. 1B in association with the image capturing space of the camera unit 20. Based on the position coordinate data of the virtual drum set D, and based on the position coordinate data of the marker unit 15 at the time of receiving the note-on event, the center unit 30 identifies a musical instrument that is virtually hit by the stick unit 10, and generates musical sound corresponding to the musical instrument.

Next, specific descriptions are provided for a configuration of the musical instrument 1 of the present embodiment.

Configuration of Musical Instrument 1

First, with reference to FIGS. 2 to 5, descriptions are provided for each component of the musical instrument 1 of the present embodiment. More specifically, descriptions are provided for the configurations of the stick unit 10, the camera unit 20 and the center unit 30.

Configuration of Stick Unit 10

Figure 2:
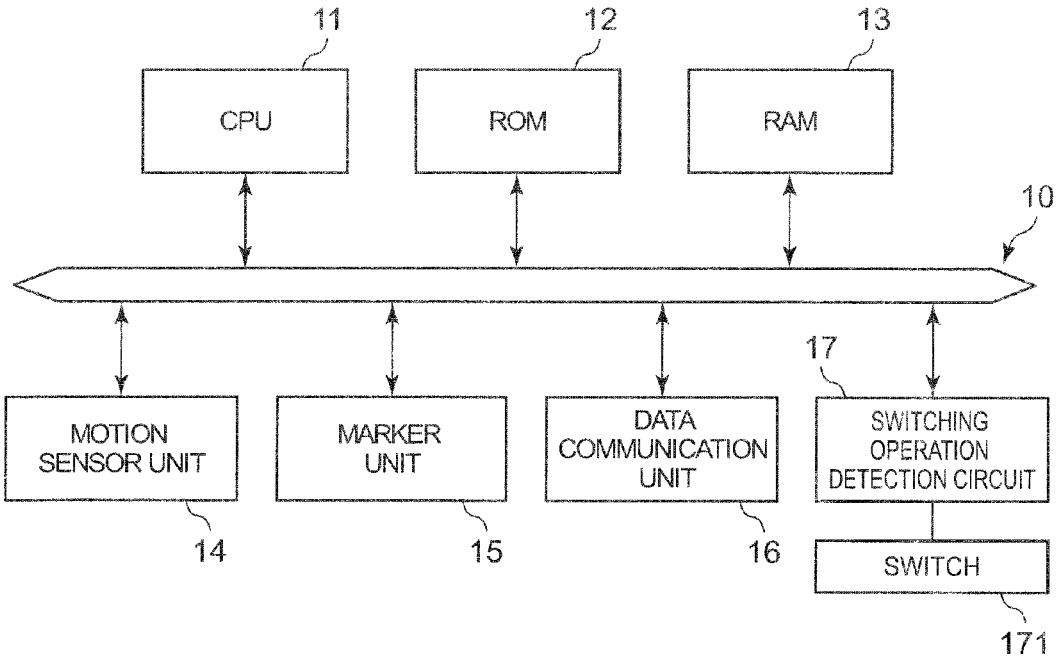
FIG. 2 is a block diagram showing a hardware configuration of a stick unit constituting the musical instrument.

FIG. 2 is a block diagram showing the hardware configuration of the stick unit 10.

As shown in FIG. 2, the stick unit 10 is configured to include a CPU 11 (Central Processing Unit), ROM (Read Only Memory) 12, RAM (Random Access Memory) 13, the motion sensor unit 14, the marker unit 15, a data communication unit 16, and a switch operation detection circuit 17.

The CPU 11 controls the entirety of the stick unit 10. For example, based on sensor values that are output from the motion sensor unit 14, the CPU 11 detects an attitude, a shot and an action of the stick unit 10, and performs controls such as light-emission and turning-off of the marker unit 15. In doing so, the CPU 11 reads marker characteristic information from the ROM 12, and controls emission of light from the marker unit 15 in accordance with the marker characteristic information. The CPU 11 controls communication with the center unit 30 via the data communication unit 16.

The ROM 12 stores processing programs for various processing to be executed by the CPU 11. The ROM 12 stores the marker characteristic information that is used for controlling emission of light from the marker unit 15. The marker characteristic information is used for distinguishing the marker unit 15 of the stick unit 10A (hereinafter referred to as "first marker" as appropriate) and the marker unit 15 of the stick unit 10B (hereinafter referred to as "second marker" as appropriate). For example, a shape, a dimension, a hue, saturation or brilliance of light emitted, a flashing speed of light emitted, etc. can be used as the marker characteristic information.

Here, the respective CPUs 11 of the stick units 10A and 10B read different marker characteristic information from the ROM 12 of the stick units 10A and 10B, respectively, and control emission of light from the markers, respectively.

The RAM 13 stores values that are acquired or generated in the processing, such as various sensor values that are output from the motion sensor unit 14.

The motion sensor unit 14 includes various sensors for detecting the states of the stick unit 10, i.e. sensors for detecting predetermined operations such as the performer's hitting of a virtual musical instrument with the stick unit 10. The motion sensor unit 14 outputs predetermined sensor values. Here, for example, an acceleration sensor, an angular velocity sensor, and a magnetic sensor can be used as the sensors that configure the motion sensor unit 14.

Figure 3:
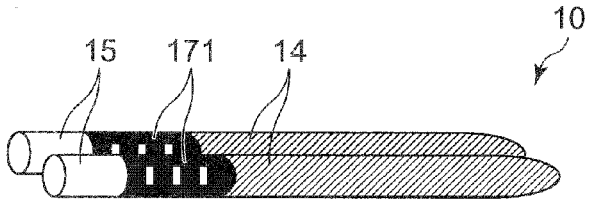
FIG. 3 is a perspective view of the stick unit.

FIG. 3 is a perspective view of the stick unit 10. Switch units 171 and the marker units 15 are disposed outside the stick unit 10.

The performer holds one end (base side) of the stick unit 10, and swings the stick unit 10 up and down using his/her wrist and the like, thereby moving the stick unit 10. In doing so, the motion sensor unit 14 outputs sensor values representing such an action.

The CPU 11 receives the sensor values from the motion sensor unit 14, thereby detecting the state of the stick unit 10 that is held by the performer. As an example, the CPU 11 detects the timing at which the stick unit 10 hits a virtual musical instrument (hereinafter also referred to as "shot timing"). The shot timing is the timing immediately before stopping the stick unit 10 after swinging the stick unit 10 down. In other words, the shot timing is the timing at which the acceleration in a direction opposite to the direction of swinging the stick unit 10 down exceeds a certain threshold value.

With reference to FIG. 2 again, the marker unit 15 is a light emitter provided on the tip side of the stick unit 10, and is configured by an LED, for example. The marker unit 15 emits light and turns off in accordance with control by the CPU 11. More specifically, the marker unit 15 emits light, based on the marker characteristic information that is read from the ROM 12 by the CPU 11. At this time, the marker characteristic information of the stick unit 10A is different from the marker characteristic information of the stick unit 10B. Therefore, the camera unit 20 can distinguish and individually acquire the position coordinates of the marker unit 15 of the stick unit 10A (first marker), and the position coordinates of the marker unit 15 of the stick unit 10B (second marker).

The data communication unit 16 performs predetermined wireless communication with at least the center unit 30. The data communication unit 16 may perform predetermined wireless communication in an arbitrary manner. In the present embodiment, the wireless communication between the data communication unit 16 and the center unit 30 is infrared communication. Wireless communication may be performed between the data communication unit 16 and the camera unit 20. Wireless communication may be performed between the data communication unit 16 of the stick unit 10A and the data communication unit 16 of the stick unit 10B.

The switch operation detection circuit 17 is connected to the switch 171, and receives input information via the switch 171. The input information includes, for example, signal information serving as a trigger for directly designating set layout information (to be described below), etc.

Configuration of Camera Unit 20

The configuration of the stick unit 10 has been described above. Next, a configuration of the camera unit 20 is described with reference to FIG. 4.

Figure 4:
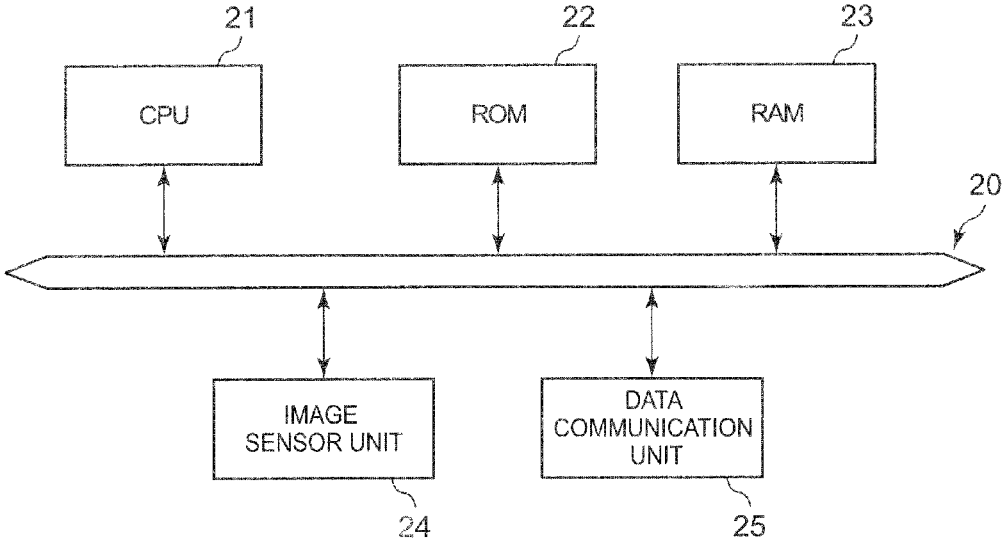
FIG. 4 is a block diagram showing a hardware configuration of a camera unit constituting the musical instrument.

FIG. 4 is a block diagram showing a hardware configuration of the camera unit 20.

The camera unit 20 is configured to include a CPU 21, ROM 22, RAM 23, an image sensor unit 24, and a data communication unit 25.

The CPU 21 controls the entirety of the camera unit 20. For example, based on the position coordinate data and the marker characteristic information of the marker units 15 detected by the image sensor unit 24, the CPU 21 calculates position coordinates (Mxa, Mya) and (Mxb, Myb) of the marker units 15 (first marker and second marker) of the stick units 10A and 10E, respectively, and outputs the position coordinate data indicating the results of such calculation. The CPU 21 controls the data communication unit 25 to transmit the position coordinate data and the like thus calculated to the center unit 30.

The ROM 22 stores processing programs for various processing to be executed by the CPU 21. The RAM 23 stores values that are acquired or generated in the processing, such as the position coordinate data of the marker unit 15 detected by the image sensor unit 24. The RAM 23 also stores the marker characteristic information of the stick units 10A and 10B received from the center unit 30.

For example, the image sensor unit 24 is an optical camera, and captures, at a predetermined frame rate, a moving image of the performer making an action for a musical performance with the stick unit 10. The image sensor unit 24 outputs the captured image data of each frame to the CPU 21. Instead of the CPU 21, the image sensor unit 24 may identify position coordinates of the marker unit 15 of the stick unit 10 in the captured image. Instead of the CPU 21, the image sensor unit 24 may also calculate position coordinates of the marker units 15 (first marker and second marker) of the stick units 10A and 10B, respectively, based on the captured marker characteristic information.

The data communication unit 25 performs predetermined wireless communication (for example, infrared communication) with at least the center unit 30. Wireless communication may be performed between the data communication unit 16 and the stick unit 10.

Configuration of Center Unit 30

The configuration of the camera unit 20 has been described above. Next, the configuration of the center unit 30 is described with reference to FIG. 5.

Figure 5:
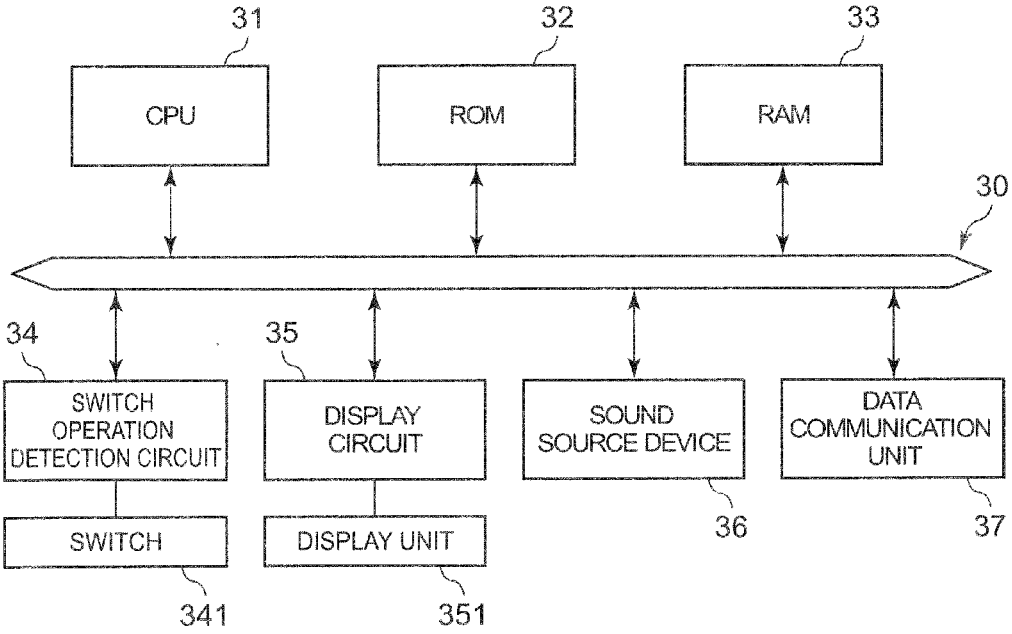
FIG. 5 is a block diagram showing a hardware configuration of a center unit composing the musical instrument.

FIG. 5 is a block diagram showing the hardware configuration of the center unit 30.

The center unit 30 is configured to include a CPU 31, ROM 32, RAM 33, a switch operation detection circuit 34, a display circuit 35, a sound source device 36, and a data communication unit 37.

The CPU 31 controls the entirety of the center unit 30. For example, when a detected shot is received from the stick unit 10, based on a distance between the position coordinates of the marker unit 15 received from the camera unit 20, and based on the central position coordinates of a plurality of virtual musical instruments, the CPU 31 identifies a virtual musical instrument for generating sound, and controls the virtual musical instrument to generate musical sound. The CPU 31 controls communication with the stick unit 10 and the camera unit 20 via the data communication unit 37.

The ROM 32 stores processing programs for various processing to be executed by the CPU 31. For each of the plurality of virtual musical instruments provided on a virtual plane, the ROM 32 stores set layout information, in which the central position coordinates, a size, and a tone of a virtual musical instrument are associated with one another. Examples of the virtual musical instruments include: wind instruments such as a flute, a saxophone and a trumpet; keyboard instruments such as a piano; stringed instruments such as a guitar; percussion instruments such as a bass drum, a high hat, a snare, a cymbal and a tom-tom; etc.

Figure 6:
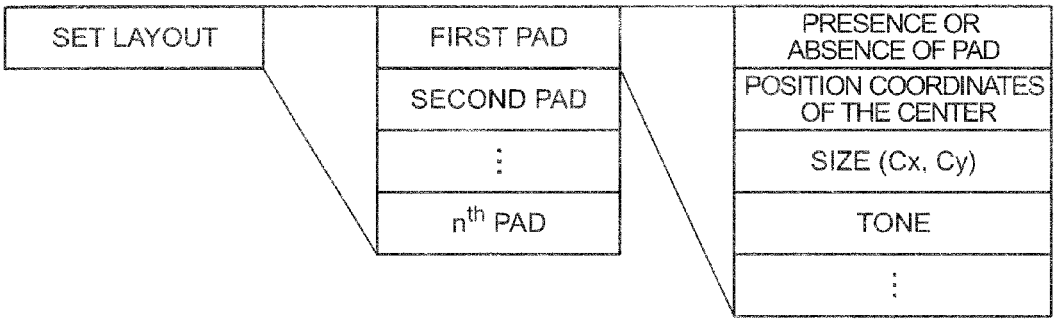
FIG. 6 is a diagram showing set layout information according to the embodiment of the musical instrument of the present invention.

For example, in the set layout information as shown in FIG. 6, a single piece of the set layout information is associated with n pieces of pad information for the first to $n^{th}$ pads, as information of virtual musical instruments. Position coordinates of the central position coordinates of a pad (position coordinates (Cx, Cy) on the virtual plane to be described below), size data of the pad (a shape, a diameter, a longitudinal length and a crosswise length of the virtual pad), and a tone (waveform data) corresponding to the pad are stored in each pad information in association. A plurality of tones of pads is stored correspondingly to distances from the central positions of the pads. For example, as shown in FIG. 6, a plurality of tones of pads is stored correspondingly to distances from the central positions of the pads. Several types of the set layout information may exist.

Figure 7:
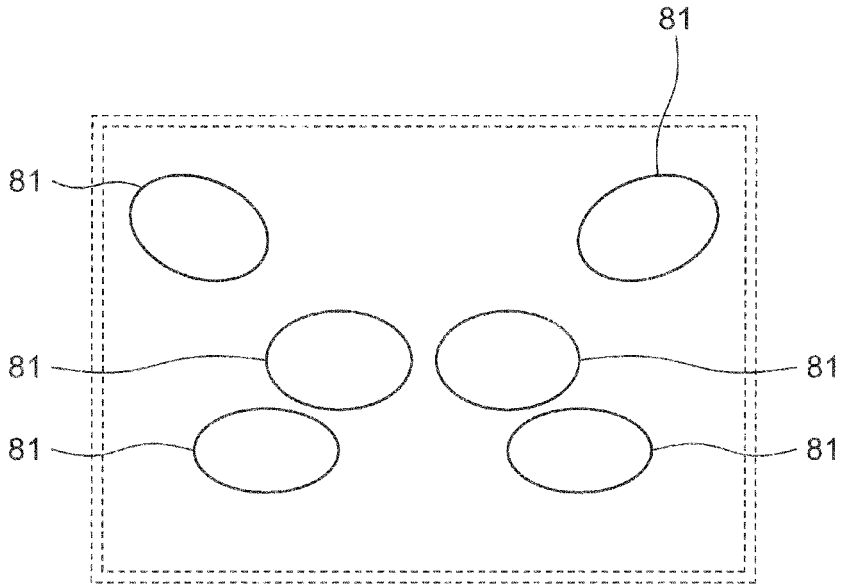
FIG. 7 is a diagram visualizing a concept indicated by the set layout information on a virtual plane.

Here, a specific set layout is described with reference to FIG. 7. FIG. 7 is a diagram visualizing a concept on a virtual plane, the concept indicated by the set layout information stored in the ROM 32 of the center unit 30.

FIG. 7 shows six virtual pads 81 arranged on the virtual plane. The six virtual pads 81 are arranged based on the position coordinates (Cx, Cy) and the size data associated with the pads. Each of the virtual pads 81 is associated with a tone corresponding to a distance from the central position of the virtual pad 81.

With reference to FIG. 5 again, the RAM 33 stores values that are acquired or generated in the processing, such as a state (shot detected) of the stick unit 10 received from the stick unit 10, and position coordinates of the marker unit 15 received from the camera unit 20.

As a result, when a shot is detected (i.e. when a note-on event is received), the CPU 31 reads, from the set layout information stored in the ROM 32, a tone (waveform data) that is associated with the virtual pad 81 corresponding to the position coordinates of the marker unit 15, and controls generation of musical sound corresponding to the performer's action for a musical performance.

More specifically, for each of the plurality of virtual pads 81, the CPU 31 calculates a distance between the central position coordinates of the virtual pad 81 and the position coordinates of the marker unit 15, by adjusting the distance to be shorter as the size (longitudinal length and crosswise length) of the virtual pad is larger. Subsequently, the CPU 31 identifies a virtual pad 81, which corresponds to the shortest distance among the distances thus calculated, as a virtual pad 81 for outputting sound. Subsequently, by referring to the set layout information, the CPU 31 identifies a tone corresponding to the virtual pad 81 for outputting sound, based on the distance between the central position coordinates of the virtual pad 81 and the position coordinates of the marker unit 15.

In a case in which the shortest distance stored by RAM 33 is larger than a predetermined threshold value that is set in advance, the CPU 31 does not identify a pad for outputting sound. In other words, in a case in which the shortest distance is not larger than the predetermined threshold value that is set in advance, the CPU 31 identifies the pad as a virtual pad 81 for outputting sound. The predetermined threshold value is stored in the ROM 32, and during a musical performance, is read from the ROM 32 by the CPU 31 and stored into the RAM 33.

The switch operation detection circuit 34 is connected to a switch 341, and receives input information via the switch 341. The input information includes, for example, change of the volume and tone of the musical sound to be generated, switch of the displaying by a display unit 351, adjustment of the predetermined threshold value, change of the central position coordinates of virtual pad 81, etc.

The display circuit 35 is connected to the display unit 351, and controls the displaying by the display unit 351.

In accordance with an instruction from the CPU 31, the sound source device 36 reads waveform data from the ROM 32 to generate musical sound data, converts the musical sound data into an analog signal, and generates musical sound from a speaker (not shown).

The data communication unit 37 performs predetermined wireless communication (for example, infrared communication) with the stick unit 10 and the camera unit 20.

Processing by Musical Instrument 1

The configurations of the stick unit 10, the camera unit 20 and the center unit 30 have been described above. Next, processing by the musical instrument 1 is described with reference to FIGS. 8 to 11.

Processing by Stick Unit 10

Figure 8:
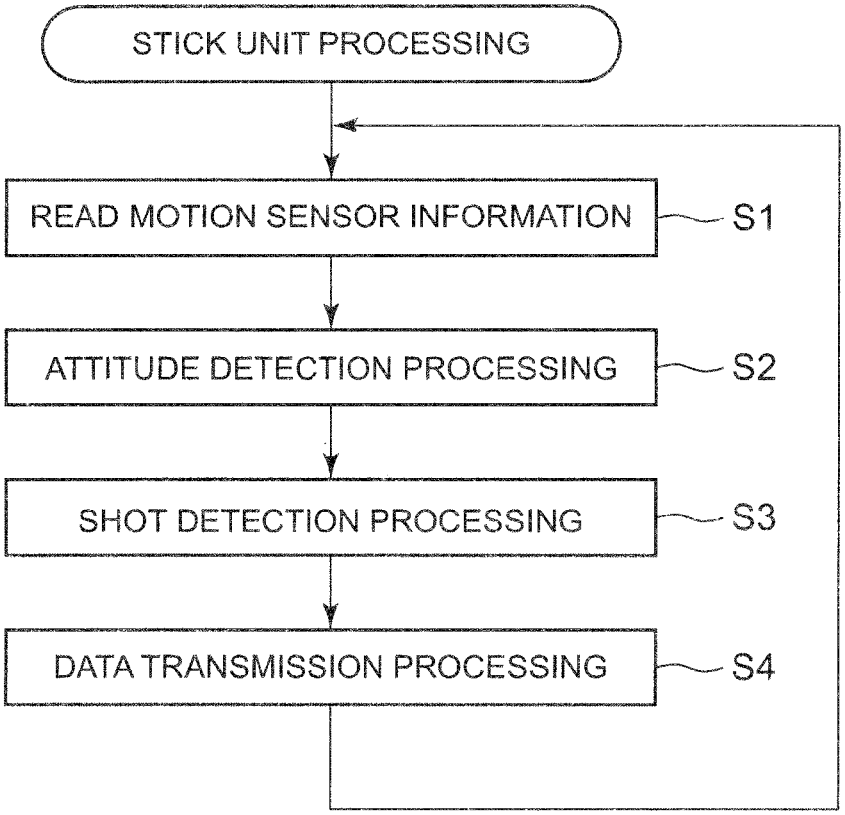
FIG. 8 is a flowchart showing a flow of processing by the stick unit.

FIG. 8 is a flowchart showing a flow of processing executed by the stick unit 10 (hereinafter referred to as "stick unit processing").

With reference to FIG. 8, the CPU 11 of the stick unit 10 reads a sensor value as motion sensor information from the motion sensor unit 14, and stores the sensor value into the RAM 13 (Step S1). Subsequently, based on the motion sensor information thus read, the CPU 11 executes attitude detection processing of the stick unit 10 (Step S2). In the attitude detection processing, the CPU 11 calculates an attitude of the stick unit 10, for example, a roll angle, a pitch angle, etc. of the stick unit 10, based on the motion sensor information.

Subsequently, the CPU 11 executes shot detection processing, based on the motion sensor information (Step S3). In a case in which the performer gives a performance using the stick unit 10, the performer makes an action for a musical performance that is similar to an action for a musical performance with a real musical instrument (for example, a drum), by assuming that there is a virtual musical instrument (for example, a virtual drum). As such an action for a musical performance, the performer first swings the stick unit 10 up, and then swings it down toward a virtual musical instrument. By assuming that musical sound is generated at the moment when the stick unit 10 hits the virtual musical instrument, the performer exerts a force attempting to stop the action of the stick unit 10, immediately before the stick unit 10 hits the virtual musical instrument. On the other hand, the CPU 11 detects such an action for attempting to stop the action of the stick unit 10, based on the motion sensor information (for example, a composite value of the acceleration sensor values).

In other words, in the present embodiment, the timing of detecting a shot is the timing immediately before stopping the stick unit 10 after swinging the stick unit 10 down, and is the timing at which the acceleration in a direction opposite to the direction of swinging the stick unit 10 down exceeds a certain threshold value. In the present embodiment, the timing of detecting a shot is the timing of generating sound.

When the CPU 11 of the stick unit 10 detects an action for attempting to stop the action of the stick unit 10, the CPU 11 determines that now is the timing of generating sound, generates a note-on event, and transmits the note-on event to the center unit 30. Here, when the CPU 11 generates the note-on event, the CPU 11 may determine a volume of musical sound to be generated, based on the motion sensor information (for example, a maximum value of the synthesized acceleration sensor values), and may include the volume in the note-on event.

Subsequently, the CPU 11 transmits the information detected by the processing in Steps S2 and S3, i.e. attitude information and shot information, to the center unit 30 via the data communication unit 16 (Step S4). At this time, the CPU 11 transmits the attitude information and the shot information in association with stick identification information to the center unit 30.

Subsequently, the CPU 11 returns the processing to Step S1. As a result, the processing from Steps S1 to S4 is repeated.

Processing by Camera Unit 20

Figure 9:
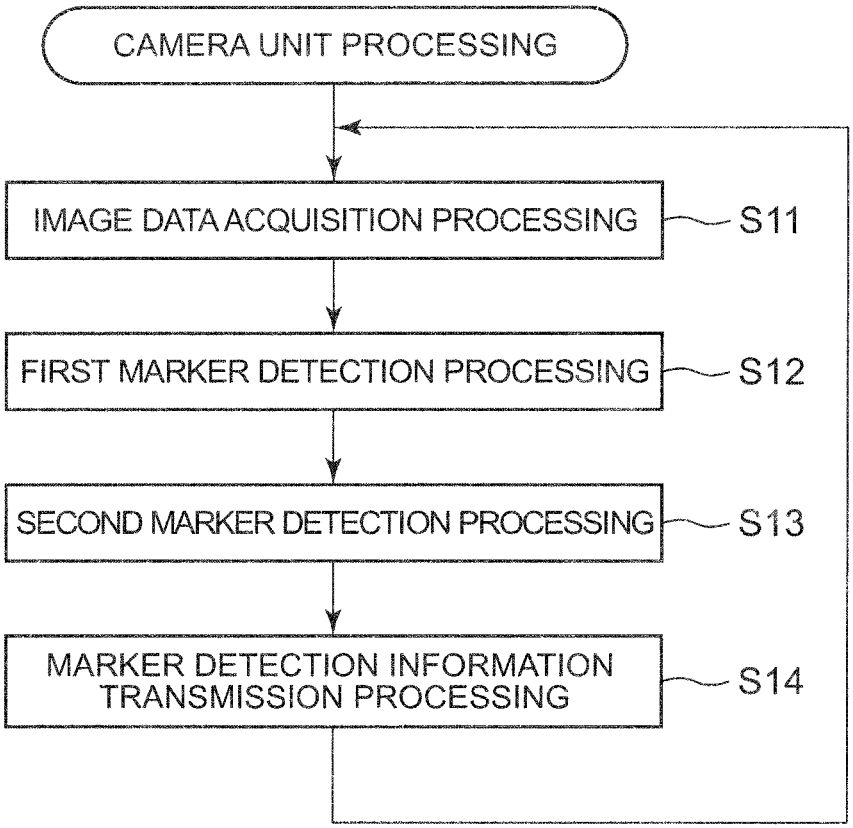
FIG. 9 is a flowchart showing a flow of processing by the camera unit.

FIG. 9 is a flowchart showing a flow of processing executed by the camera unit 20 (hereinafter referred to as "camera unit processing").

With reference to FIG. 9, the CPU 21 of the camera unit 20 executes image data acquisition processing (Step S11). In this processing, the CPU 21 acquires image data from the image sensor unit 24.

Subsequently, the CPU 21 executes first marker detection processing (Step S12), and second marker detection processing (Step S13). In the processing, the CPU 21 acquires marker detection information detected by the image sensor unit 24, such as position coordinates, a size, an angle, etc. of the marker unit 15 of the stick unit 10A (the first marker) and the stick unit 10B of the marker unit 15 (the second marker), and stores the marker detection information into the RAM 23. At this time, the image sensor unit 24 detects marker detection information of the marker unit 15 that is emitting light.

Subsequently, the CPU 21 transmits the marker detection information acquired in Steps S12 and S13 to the center unit 30 via the data communication unit 25 (Step S14), and advances the processing to Step S11. As a result, the processing from Steps S11 to S14 is repeated.

Processing by Center Unit 30

Figure 10:
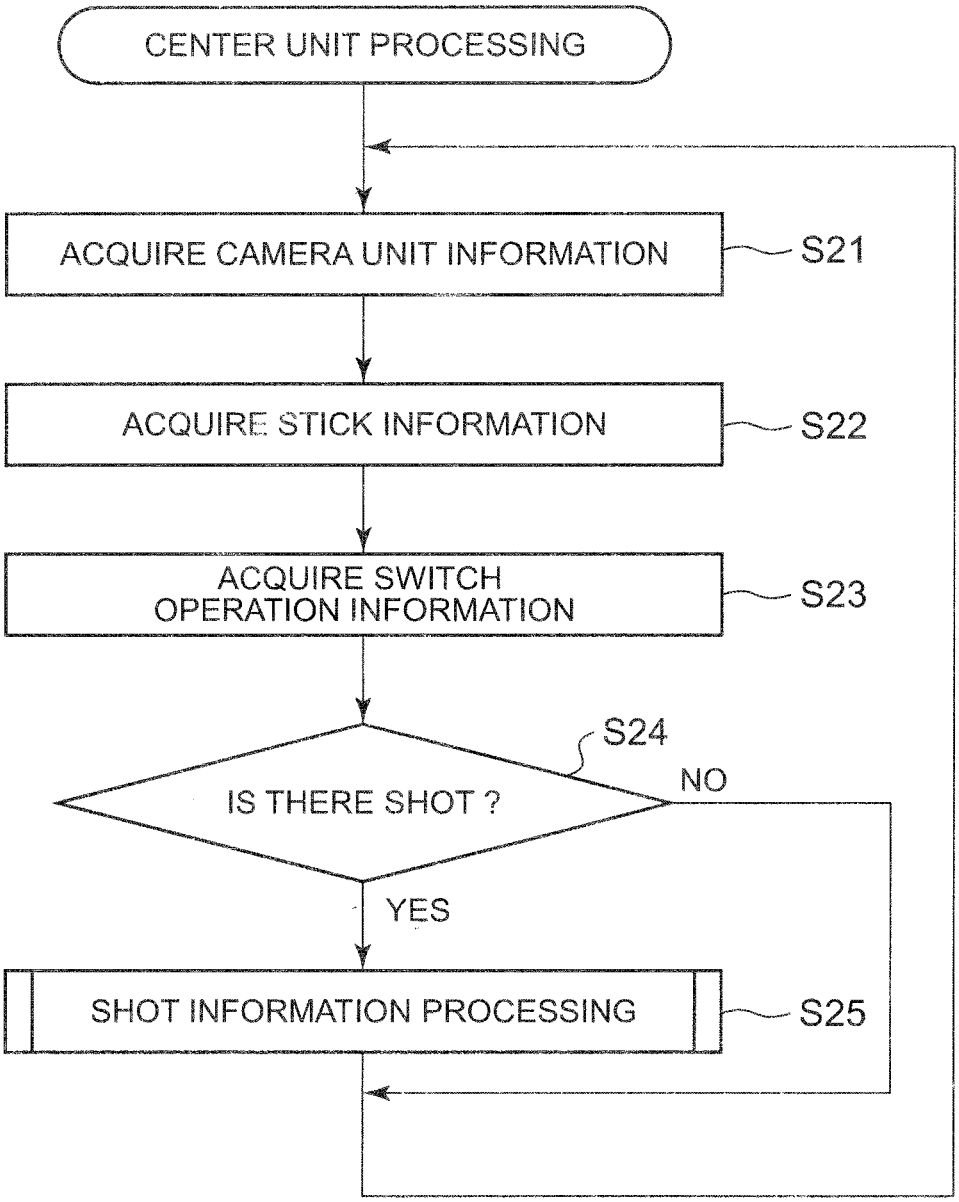
FIG. 10 is a flowchart showing a flow of processing by the center unit.

FIG. 10 is a flowchart showing a flow of processing executed by the center unit 30 (hereinafter referred to as "center unit processing").

With reference to FIG. 10, the CPU 31 of the center unit 30 receives the first and second marker detection information from the camera unit 20, and stores the marker detection information into the RAM 33 (Step S21). The CPU 31 receives the attitude information and the shot information associated with the stick identification information from the stick units 10A and 10B, and stores the information into the RAM 33 (Step S22). The CPU 31 acquires information that is input by operating the switch 341 (Step S23).

Subsequently, the CPU 31 determines whether there is a shot (Step S24). In this processing, the CPU 31 determines whether there is a shot, depending upon whether a note-on event is received from the stick unit 10. At this time, in a case in which the CPU 31 determines that there is a shot, the CPU 31 executes shot information processing (Step S25), and then returns the processing to Step S21. The shot information processing will be described in detail with reference to FIG. 11. On the other hand, in a case in which the CPU 31 determines that there is no shot, the CPU 31 advances the processing to Step S21.

Figure 11:
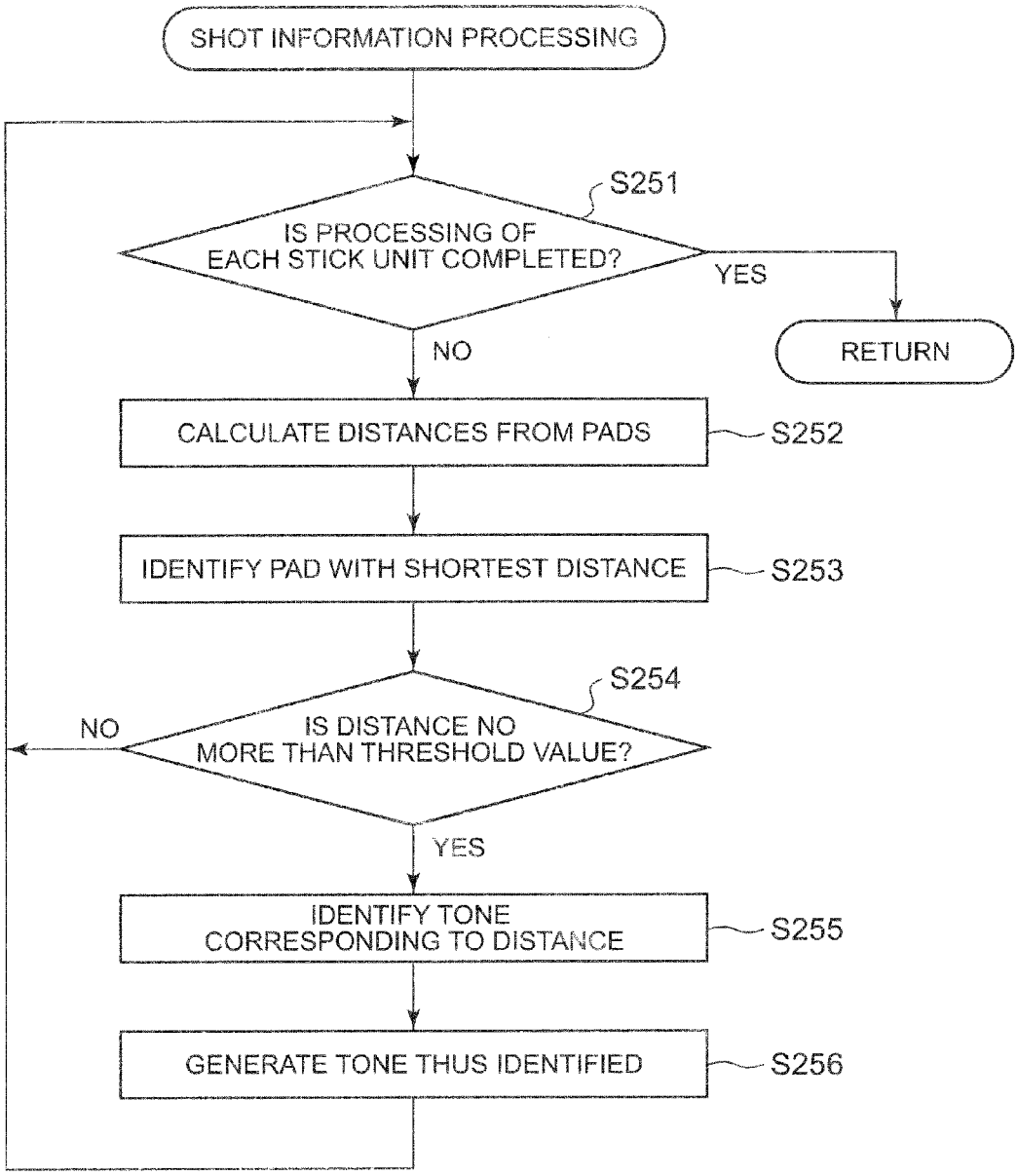
FIG. 11 is a flowchart showing a flow of shot information processing by the center unit.

FIG. 11 is a flowchart showing a flow of the shot information processing by the center unit 30.

With reference to FIG. 11, the CPU 31 of the center unit 30 determines whether the processing of each of the stick units 10 is completed (Step S251). In this processing, in a case in which the CPU 31 has received note-on events concurrently from the stick units 10A and 10B, the CPU 31 determines whether the processing corresponding to both note-on events is completed. At this time, in a case in which the CPU 31 determines that the processing corresponding to the respective note-on events is completed, the CPU 31 executes return processing. In a case in which the CPU 31 determines that the processing of each marker is not completed, the CPU 31 advances the processing to Step S252. In a case in which the CPU 31 has received both note-on events, the CPU 31 sequentially executes processing from the processing corresponding to the stick unit 10A; however, the processing is not limited thereto. The CPU 31 may sequentially execute processing from the processing corresponding to the stick unit 10B.

Subsequently, the CPU 31 calculates a distance Li (where $1 \leq i \leq n$) between the position coordinates of the centers of the plurality of virtual pads 81 included in the set layout information that is read into the RAM 33, and the position coordinates of the marker unit 15 of the stick unit 10 included in the marker detection information (Step S252).

Among the n number of pads associated with the set layout information, it is assumed that the central position coordinates of the $i^{th}$ pad (where $1 \leq i \leq n$) are (Cxi, Cyi), a crosswise size is Sxi, a longitudinal size is Syi, position coordinates of the marker unit 15 are (Mxa, Mya), and a crosswise distance and a longitudinal distance between the central position coordinates and the position coordinates of the marker unit 15 are Lxi and Lyi, respectively. The CPU 31 calculates Lxi by Equation (1) shown below, and calculates Lyi by Equation (2) shown below.

$$Lxi=(Cxi-Mxa)*(K/Sxi) \quad (1)$$

$$Lyi=(Cyi-Mya)*(K/Syi) \quad (2)$$

Here, K is a weighting coefficient of the size, and is a constant that is common in the calculation of each part. The weighting coefficient K may be set so as to be different between a case of calculating the crosswise distance Lxi and a case of calculating the longitudinal distance Lyi.

In other words, after calculating the crosswise distance Lxi and the longitudinal distance Lyi, the CPU 31 divides the calculated distances by Sxi and Syi, respectively, thereby making adjustment such that the distances are smaller as the size of the virtual pad 81 is larger.

Subsequently, by using the crosswise distance Lxi and the longitudinal distance Lyi thus calculated, the CPU 31 calculates the distances Li by Equation (3) shown below.

$$Li=((Lxi*Lxi)+(Lyi*Lyi))\hat{}(1/2) \quad (3)$$

Here, "^" is an operator for performing exponential multiplication. In other words, "^½" in Equation (3) indicates ½ power.

Subsequently, based on the plurality of distances Li calculated in Step S252, the CPU 31 identifies a pad with the shortest distance (Step S253). Subsequently, the CPU 31 determines whether the distance corresponding to the virtual pad 81 thus identified is smaller than a predetermined threshold value that is set in advance (Step S254). In a case in which the CPU 31 determines that the distance is not more than the predetermined threshold value that is set in advance, the CPU 31 advances the processing to Step S255. In a case in which the CPU 31 determines that the distance is larger than the predetermined threshold value that is set in advance, the CPU 31 returns the processing to Step S251.

Subsequently, in a case in which the distance Li corresponding to the virtual pad 81 thus identified is smaller than the threshold value that is set in advance, the CPU 31 identifies the tone (waveform data) of the virtual pad 81 corresponding to the distance Li (Step S255). In other words, the CPU 31 refers to the set layout information that is read into the RAM 33, selects a tone (waveform data) corresponding to the calculated distance from among the tones (waveform data) of the virtual pad 81 thus identified, and outputs the tone to the sound source device 36 together with the volume data included in the note-on event. For example, in a case in which the identified virtual pad 81 is associated with a cymbal, and the distance Li is a first distance, the CPU 31 selects a tone corresponding to a cup area (center) of the cymbal. In a case in which the distance Li is a second distance that is longer than the first distance, the CPU 31 selects a tone corresponding to a ride area. In a case in which the distance Li is a third distance that is longer than the second distance, the CPU 31 selects a tone corresponding to a crash area (edge portion). The sound source device 36 generates corresponding musical sound, based on the waveform data thus received (Step S256).

The configuration and the processing of the musical instrument 1 of the present embodiment have been described above.

In the present embodiment, the CPU 31 of the musical instrument 1 calculates distances between the central position coordinates of the plurality of virtual pads 81 and the position coordinates thus detected, by making adjustment such that the distance is shorter as the size of the virtual pad 81 is larger. Subsequently, the CPU 31 identifies a virtual pad 81, which corresponds to the shortest distance among the distances thus calculated, as a virtual musical instrument for outputting sound, refers to the set layout information, and identifies a tone corresponding to the virtual pad 81 for outputting sound.

Therefore, even in a case in which the marker unit 15 of the stick unit 10 operated by the performer is not included in a range that covers the size of the virtual pad 81, the musical instrument 1 can generate sound by selecting a virtual pad 81 that is closest to the position of marker unit 15. Therefore, even if the performer is inexperienced in the operation, the musical instrument 1 can generate sound by detecting an action for a musical performance intended by the performer.

In the present embodiment, the CPU 31 of the musical instrument 1 calculates the crosswise distance and the longitudinal distance, in the virtual plane, between the central position coordinates of the plurality of virtual pads 81 and the position coordinates thus detected; adjusts the crosswise distance and the longitudinal distance thus calculated, such that the distance is shorter as the size of the virtual pad 81 is larger; and calculates a distance between the central position coordinates and the position coordinates detected by the CPU 21, based on the crosswise distance and the longitudinal distance thus adjusted.

Therefore, the musical instrument 1 can adjust each of the crosswise distance and the longitudinal distance, and thus can adjust the distances more finely than a case of simply adjusting a distance per In the present embodiment, the ROM 32 stores the set layout information of the plurality of virtual pads 81, in which a distance from the central position coordinates is associated with a tone corresponding to the distance; and the CPU 31 refers to the set layout information stored in the ROM 32, and identifies, as sound to be generated, a tone that is associated with the distance corresponding to the virtual pad 81 for generating sound.

Therefore, the musical instrument 1 can generate different tones depending on the distance from the central position of the virtual pad 81, and thus can generate more realistic sound by, for example, differentiating sound generated from the center of the musical instrument, and sound generated from the edge portion of the musical instrument.

In the present embodiment, in a case in which the shortest distance among the calculated distances is not more than a predetermined threshold value, the CPU 31 identifies the virtual pad 81 corresponding to the shortest distance as a virtual pad 81 for outputting sound.

Therefore, the musical instrument 1 can execute control so as not to generate sound in a case in which the operating position of the stick unit 10 of the performer is remarkably deviated from the position of the virtual pad 81.

In the present embodiment, the switch operation detection circuit 34 of the musical instrument 1 adjusts the setting of the predetermined threshold value through operations by the performer.

Therefore, the musical instrument 1 can change the accuracy level of whether sound is generated in response to an operation by the performer, for example, by setting a predetermined threshold value. For example, the accuracy level of whether sound is generated can be set lower in a case in which the performer is inexperienced, and can be set higher in a case in which the performer is experienced.

In the present embodiment, the switch operation detection circuit 34 of the musical instrument 1 sets the central position coordinates of the virtual pads 81 according to operations by the performer.

Therefore, with the musical instrument 1, the performer can change the positions of the virtual pads 81 by simply adjusting the setting of the central position coordinates of the virtual pads 81. Therefore, the musical instrument 1 can set the positions of the virtual pads 81 more easily than a case of defining positions of the virtual pads 81 for generating sound in a grid provided on a virtual plane.

Although the embodiment of the present invention has been described above, the embodiment is merely exemplification, and does not limit the technical scope of the present invention. Various other embodiments can be adopted for the present invention, and various modifications such as omissions and substitutions are possible without departing from the spirit of the present invention. The embodiment and modifications thereof are included in the scope of the invention and the summary described in the present specification, and are included in the invention recited in the claims as well as the equivalent scope thereof.

In present application, as described above, a "distance" as simply described as a "distance" may be a "constructive distance" in which a real distance between the central position coordinates and the position coordinates of the marker unit 15 is divided by the size of each pad, and a part of the processing may be executed using the real "distance" per se. For example, when the tone of each pad is determined, a real distance between the central position coordinates and the position coordinates of the marker unit 15 can be used as well.

In the above embodiment, the virtual drum set D (see FIG.1A and FIG.1B) is described as an example of a virtual percussion instrument; however, the present invention is not limited thereto. The present invention can be applied to other musical instruments such as a xylophone that generates musical sound through an action of swinging the stick unit 10 down.

In the above embodiment, any of the processing to be executed by the stick unit 10, the camera unit 20 and the center unit 30 may be executed by another unit (the stick unit 10, the camera unit 20 and the center unit 30). For example, the processing such as detecting a shot and calculating a roll angle to be executed by the CPU 11 of the stick unit 10 may be executed by the center unit 30.

For example, the CPU 31 may automatically adjust a predetermined threshold value in accordance with a particular status of the virtual pad 81 corresponding to the shortest distance. For example, the predetermined threshold value may be set smaller for a performer whose particular ratio of the virtual pad 81 corresponding to the shortest distance is higher, and the predetermined threshold value may be set larger for a performer whose particular ratio of the virtual pad 81 is lower.

The processing sequence described above can be executed by hardware, and can also be executed by software.

In other words, the configurations shown in FIGS. 2 to 5 are merely illustrative examples, and the present invention is not particularly limited thereto. More specifically, the types of configurations constructed to realize the functions are not particularly limited to the examples shown in FIGS. 2 to 5, so long as the musical instrument 1 includes functions enabling the sequence of processing to be executed as its entirety.

In a case in which the sequence of processing is executed by software, a program configuring the software is installed from a network or a recording medium into a computer or the like.

The computer may be a computer incorporating special-purpose hardware. Alternatively, the computer may be a computer capable of executing various functions by installing various programs.

What is claimed is:

1. A musical instrument, comprising:

a musical performance member that is operated by a performer;

an operation detection unit that detects a predetermined operation performed by the musical performance member;

an image capturing unit that captures an image including the musical performance member;

a position detection unit that detects a position of the musical performance member on a plane of the image captured;

a storage unit that stores layout information including a representing position and a size of a virtual musical instrument, for each of a plurality of virtual musical instruments provided on the plane of the image captured;

a distance calculation unit that calculates distances between a position detected by the position detection unit and respective representing positions of the virtual musical instruments, based on corresponding sizes of the virtual musical instruments, when the operation detection unit detects the predetermined operation;

a musical instrument identification unit that identifies a virtual musical instrument corresponding to the shortest distance among the distances calculated by the distance calculation unit; and a sound generation instruction unit that instructs generation of musical sound corresponding to the virtual musical instrument identified by the musical instrument identification unit.

2. The musical instrument according to claim 1, wherein the distance calculation unit makes adjustment such that the distance to be calculated is shorter as the corresponding size of the virtual musical instrument is larger.

3. The musical instrument according to claim 2, wherein the sound generation instruction unit instructs generation of musical sound of a tone that is determined based on the virtual musical instrument identified by the musical instrument identification unit and on the shortest distance.

4. The musical instrument according to claim 3, wherein the musical instrument identification unit identifies a corresponding virtual musical instrument when the shortest distance among distances calculated by the distance calculation unit is less than a predetermined threshold value.

5. The musical instrument according to claim 4, further comprising a threshold value setting unit that sets the predetermined threshold value.

6. The musical instrument according to claim 2, wherein the musical instrument identification unit identifies a corresponding virtual musical instrument when the shortest distance among distances calculated by the distance calculation unit is less than a predetermined threshold value.

7. The musical instrument according to claim 6, further comprising a threshold value setting unit that sets the predetermined threshold value.

8. The musical instrument according to claim 1, wherein the sound generation instruction unit instructs generation of musical sound of a tone that is determined based on the virtual musical instrument identified by the musical instrument identification unit and on the shortest distance.

9. The musical instrument according to claim 8, wherein the musical instrument identification unit identifies a corresponding virtual musical instrument when the shortest distance among distances calculated by the distance calculation unit is less than a predetermined threshold value.

10. The musical instrument according to claim 9, further comprising a threshold value setting unit that sets the predetermined threshold value.

11. The musical instrument according to claim 1, wherein the musical instrument identification unit identifies a corresponding virtual musical instrument when the shortest distance among distances calculated by the distance calculation unit is less than a predetermined threshold value.

12. The musical instrument according to claim 11, further comprising a threshold value setting unit that sets the predetermined threshold value.

13. The musical instrument according to claim 1, further comprising a representing position setting unit that sets a representing position of each of the virtual musical instruments.

14. A non-transitory computer-readable recording medium having stored thereon a program for controlling a control unit of a musical instrument that includes: a musical performance member that is operated by a performer and for which a predetermined operation thereof is detected; an image capturing unit that captures an image including the musical performance member, and detects a position of the musical performance member on a plane of the image captured; and a storage unit that includes layout information including a representing position and a size of a virtual musical instrument, for each of a plurality of virtual musical instruments provided on the plane of the image captured, and wherein the program controls the control unit to execute functions of:

a distance calculating step of calculating distances between respective representing positions of the plurality of virtual musical instruments and a position of the musical performance member detected, based on a corresponding size of each of the virtual musical instruments, when a predetermined operation performed by the musical performance member is detected;

a musical instrument identifying step of identifying a virtual musical instrument corresponding to the shortest distance among distances calculated in the distance calculating step; and a sound generation instructing step of instructing generation of musical sound corresponding to the virtual musical instrument identified.

15. A method of controlling a musical instrument that includes: a musical performance member that is operated by a performer and for which a predetermined operation thereof is detected; an image capturing unit that captures an image including the musical performance member, and detects a position of the musical performance member on a plane of the image captured; and a storage unit that includes layout information including a representing position and a size of a virtual musical instrument, for each of a plurality of virtual musical instruments provided on the plane of the image captured, the method comprising:

a distance calculating step of calculating distances between respective representing positions of the plurality of virtual musical instruments and a position of the musical performance member detected, based on a corresponding size of each of the virtual musical instruments, when a predetermined operation performed by the musical performance member is detected;

a musical instrument identifying step of identifying a virtual musical instrument corresponding to the shortest distance among the distances calculated in the distance calculating step; and a sound generation instructing step of instructing generation of musical sound corresponding to the virtual musical instrument identified.

* * * * *